US005779210A

United States Patent [19]

Canson et al.

[11] Patent Number: 5,779,210

[45] Date of Patent: Jul. 14, 1998

[54] DECORATIVE CLAY POT HANGERS

[76] Inventors: Barney Canson, 2406 Golden Pond, Kingwood, Tex. 77345; Jack Canson, 505 Elmwood St., Marshall, Tex. 75670

[21] Appl. No.: 599,080

[22] Filed: Feb. 9, 1996

[51] Int. Cl.[6] ..... A47H 1/10

[52] U.S. Cl. ..... 248/318; 47/67

[58] Field of Search ..... 248/318, 317, 248/328, 339, 312, 313, 231.61, 229.13, 228.4, 230.4, 231.51; 47/39, 67

[56] References Cited

U.S. PATENT DOCUMENTS

| | | | |
|---|---|---|---|
| 1,115,166 | 10/1914 | Brooks | 248/318 |
| 1,536,361 | 5/1925 | Tumes | 248/228.4 |
| 2,006,083 | 6/1935 | Dixon | 248/312.1 |
| 2,496,851 | 2/1950 | Bochau | 248/318 |
| 2,533,845 | 12/1950 | Stender | 248/318 |
| 2,967,691 | 1/1961 | Lehnbeuter et al. | 248/312.1 |
| 3,184,206 | 5/1965 | Steen | 248/318 |
| 3,193,234 | 7/1965 | Thurman et al. | 248/313 |
| 4,240,602 | 12/1980 | McDonald | 248/317 |
| 4,440,371 | 4/1984 | Wijsman | 248/318 |
| 4,452,415 | 6/1984 | Arnold | 248/313 |
| 4,811,475 | 3/1989 | Morton, Jr. | 248/317 |
| 4,846,431 | 7/1989 | Pflieger | 248/229.13 X |
| 4,953,820 | 9/1990 | Yoder | 248/231.51 X |
| 5,381,993 | 1/1995 | Eckler | 248/312.1 |

*Primary Examiner*—Ramon O. Ramirez
*Assistant Examiner*—Anita M. King
*Attorney, Agent, or Firm*—Gunn & Associates P.C.

[57] ABSTRACT

A hanger is provided for a clay pot which is constructed with a top circling lip or rim of increased thickness, and wherein the rim has a nether lip surface for engagement. In first and second embodiments, the hanger includes a plurality of clamps having an exterior and an interior arm, the two arms being in contact at one position at a fulcrum point. The two arms are joined together by an elongate rod or bolt which is fastened to one arm and extends through the other arm and which threads to a locking ball. On the exterior, the locking ball and the exterior arm are shown as a decorative clamp. The overhead portion of the hanger utilizes an upwardly extending suspension member for each of the plurality clamps.

13 Claims, 5 Drawing Sheets

240
243
42'
241
60
40
48

239
42
42'
60
40
48

236
236'
42
237
60
40
48

234
235
42'
42
60
40
48

232
233
42
43
42'
60
40
48

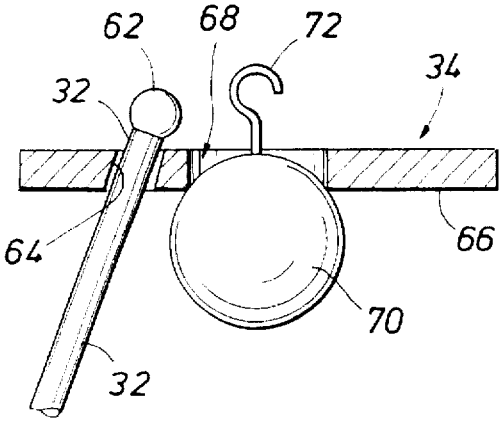
FIG. 8
FIG. 9
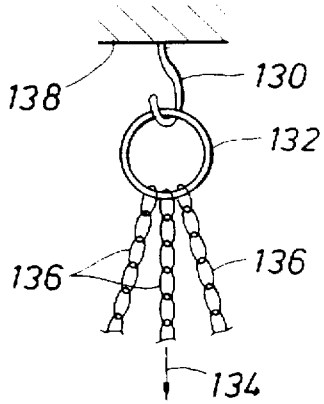
FIG. 10a
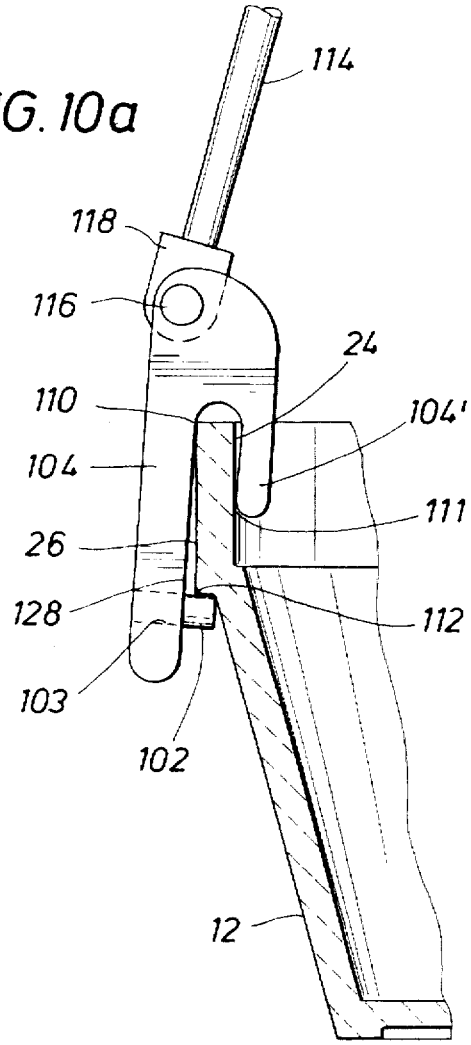
FIG. 10b
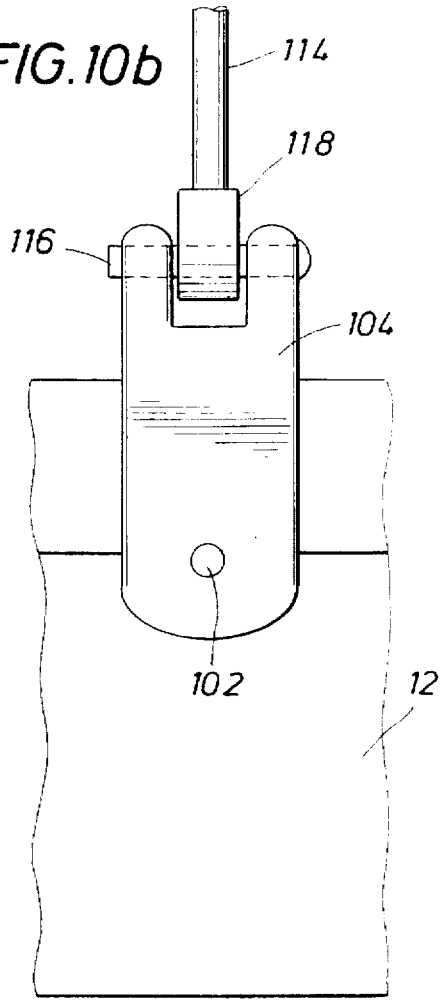

DECORATIVE CLAY POT HANGERS

BACKGROUND OF THE DISCLOSURE

A clay pot is a decorative pot which is used to grow various plants. The pot is filled with dirt or other potting material including mulch, the plant is placed in it, and water is added often. If the plant has any size, the pot of necessity must be significantly larger to hold the soil, water and plant. The pot is large and unwieldy. While there are thin walled plastic pots, decorators tend to prefer clay pots made with earth tone colors. They are traditional and add a touch of realism. Depending on the location in the country, the amount of mulch in the pot, and the water requirements of the plants in the pot, it is necessary to periodically water the pot. This water increases the weight even more. In view of the fact that the pot itself is heavy, even when empty, it is difficult to make clay pots that are moveable.

While many clay pots rest on the floor or on the porch, a number will typically be hung from a wall or an overhanging eave so that the pot positions the plant to brighten the doorway, porch, or other area where the pots are installed. It is not uncommon to hang several pots from an overhead beam. It is not uncommon to put a number of pots in a given area with different sizes. Overhead pot hangers are required to hold a substantial weight. The present disclosure sets forth a clay pot hanger which consists of two or more hanger clamp assemblies and a suspension assembly. In the preferred embodiment, each clamp assembly "grabs" the top rim of the pot. The suspension assembly consists of a plurality of suspension members, with preferably one member extending upward from each clamp to a central suspension point. Various suspension members may be used as will be discussed in detail in the following disclosure. The clay pot hanger is strong, stable, suitable for mass production, easy to install, cost effective, and visually attractive. The clamp assemblies are preferably made primarily of metal such as aluminum although other materials or combinations of materials can be used. As an example, some or essentially all of the elements of the clamp assembly can be made of plastic. In an alternate embodiment, elements of the clamp assemblies can be made of wood, primarily for decorative purposes.

Chain, rods, rope or cable are preferably used as the suspension assemblies in the suspension system. The chain is preferably made of plastic or metal. Rods can be made of plastic, metal, or even wood or cane for decorative purposes. A non clamping embodiment is also disclosed. An central suspension mechanism is arranged so the pot can hang from an overhead beam or eave.

This arrangement provides a relatively attractive pot hanger which is distinctly stronger, more durable, and more attractive than the widely used "string" type pot hangers. The present hanger is also considered to be more attractive than a typical metal clamp which is also widely used to secure a pot from an adjacent wall. Such clamps typically include a mounting bracket and an extending hook and ledge. In addition, the present hanger is considered to be more attractive than the overhead wire system which hangs the pot in some form or fashion.

Another aspect of this disclosure sets forth a system which can be used on a pot of differing diameter. Many hangers heretofore have been limited to a particular pot size. Clay pots are typically fired in a kiln after having been shaped. It is therefore to be anticipated that several pots having the same nominal size will, in fact, differ. Even a fraction of an inch difference causes problems for certain types of hangers. The clay pot hanger of the present disclosure can be used with a pot having a nominal diameter, and then switched to a larger or smaller pot. The precise diameter of the pot can vary.

In another aspect, pots of different vendors can be grasped or clamped by the clay pot hanger of the present disclosure. It is a matter of indifference with regard to the specific dimensions of the surrounding rim or border at the top of the pot. This rim or border can be thick or thin. The rim or border can be varied so that the height and offset or lip of the rim can be varied. Such clay pots typically vary from vendor to vendor because there appears to be a rather generalized industry standard but there is no specific requirement for a particular dimension lip or height of lip.

Another advantage of the present system is that the hanger of this disclosure can be disassembled and stored as a relatively small device and yet can grasp and hold a large pot. The device of the present disclosure can be built with suspension members of any appropriate length. The suspension members can be varied so they are able to grasp a large variety of pots. Indeed, the present system can be used with any number of clamps and associated suspension members. As mentioned previously, a plurality of suspension members can be employed as will be subsequently disclosed. It is, however, anticipated that the most common deployment of the present invention is to replicate the hanger with two or possibly three identical clamp elements arranged in a circle around the pot so the pot is held at two or possibly three locations that are more or less spaced evenly around the circle of the rim. This clamp arrangement distributes the weight evenly.

BRIEF SUMMARY OF THE PRESENT DISCLOSURE

This disclosure sets forth an individual clay pot hanger which consists of two or more clamp assemblies and a suspension assembly. The clamp assemblies are made preferably from primarily metal or plastic, although other materials can be used. The clay pot is constructed with an external lip which the clamp assemblies grasp. In the preferred embodiment, the clamp assemblies consist of two arms and a pivot point which also serves as a locking member. One arm grasps the inside of the top rim of the pot and the other arm reaches on the exterior of the rim to grasp the outer edge of the rim of the clay pot. In the latter instance, the device reaches down and under the rim of the clay pot to engage below the encircling rim. A pivotal connection is provided so the two components of the clamp pivot into a clamping position and are held in the clamped position. A suitable fastener is provided which consists of a threaded rod and which engages a preferably decorative, threaded ball. In addition, and embodiment employing non clamping hangers is also disclosed.

The suspension assembly of the clay pot hanger consists of at least two suspension members. One end of each suspension member is affixed to the upper end of each clamp assembly. The suspension members extend upward from the clamp assemblies such that each end of each suspension member extends to and preferably connects to a central suspension assembly for the clay pot hanger. This central suspension assembly is typically affixed to an eave or overhead beam. A number of suspension assemblies are disclosed. The suspension members can be made of chain, rod, rope or cable, and materials used to fabricate these members can be varied as will be discussed. Likewise, a variety of connections between the suspension members and the clamp assemblies are disclosed.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 8 illustrates a central suspension assembly for a pot hanger using rods as suspension members;

FIG. 9 illustrates a central suspension assembly for a pot hanger using chain as suspension members; and FIGS. 10*a* and 10*b* show a non clamping type pot suspension device.

DETAILED DESCRIPTION OF THE PREFERRED EMBODIMENTS

Figure 1:
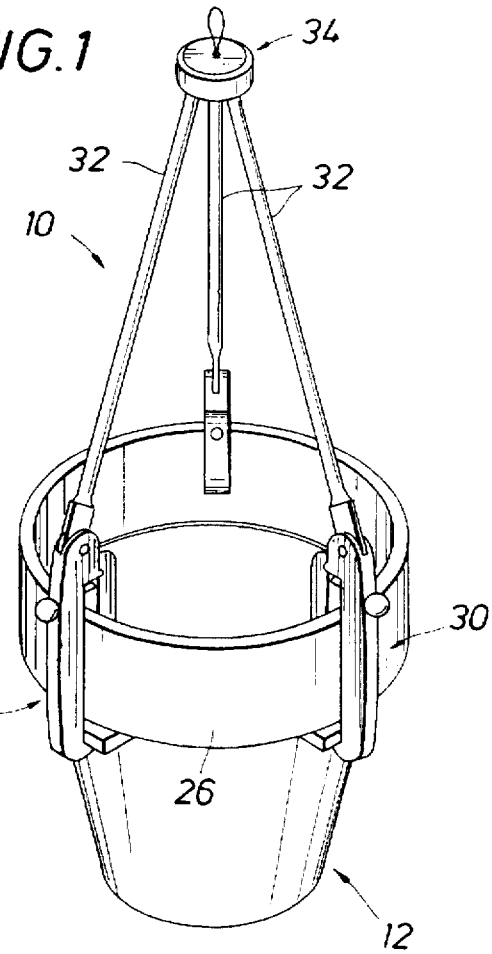
FIG. 1 shows a pot hanging from the present system wherein three suspension members support three clamp assemblies for a clay pot an wherein the rods extend to a central connective point at the upper end.

Attention is first directed to FIG. 1 of the drawings where the numeral 10 identifies the hanger of the present disclosure where three clamp assemblies are used to support a clay pot, which is generally indicated by the numeral 12. The clay pot will be described first to provide appropriate nomenclature and to set forth the nature of the hanging mechanism in cooperation with the clay pot 12. Going momentarily to FIG. 2 of the drawings, the clay pot 12 includes a bottom 14 which is typically perforated at the center for water drainage. It has a tapered side wall 16. Typically it extends outwardly with a modest taper of about five to fifteen degrees. The pot has a thickened rim or lip 18 at the top border or edge which forms a full circle. This thickened lip is constructed with a downwardly facing shoulder 20 which is approximately parallel to the top face 22. The top face 22 is defined between a pair of concentric side walls 24 and 26. The walls 24 and 26 are evenly spaced and are concentric. This defines the thickened lip or rim which encircles the top edge of the pot. Moreover, it defines the lower lip or face 20 which enables clamping as will be described.

Going back to FIG. 1 of the drawings, it will be noted that the pot 12 is relatively larger at the upper end, and is constructed with the surrounding outer face 26. Face 26 is presented to the clamps 30, there being three such clamps which are supported on upwardly extending suspension members 32, which extend to a central overhead connector 34. To better understand the apparatus of the present disclosure, FIG. 2 is a sectional view through one of the clamps 30.

Figure 2:
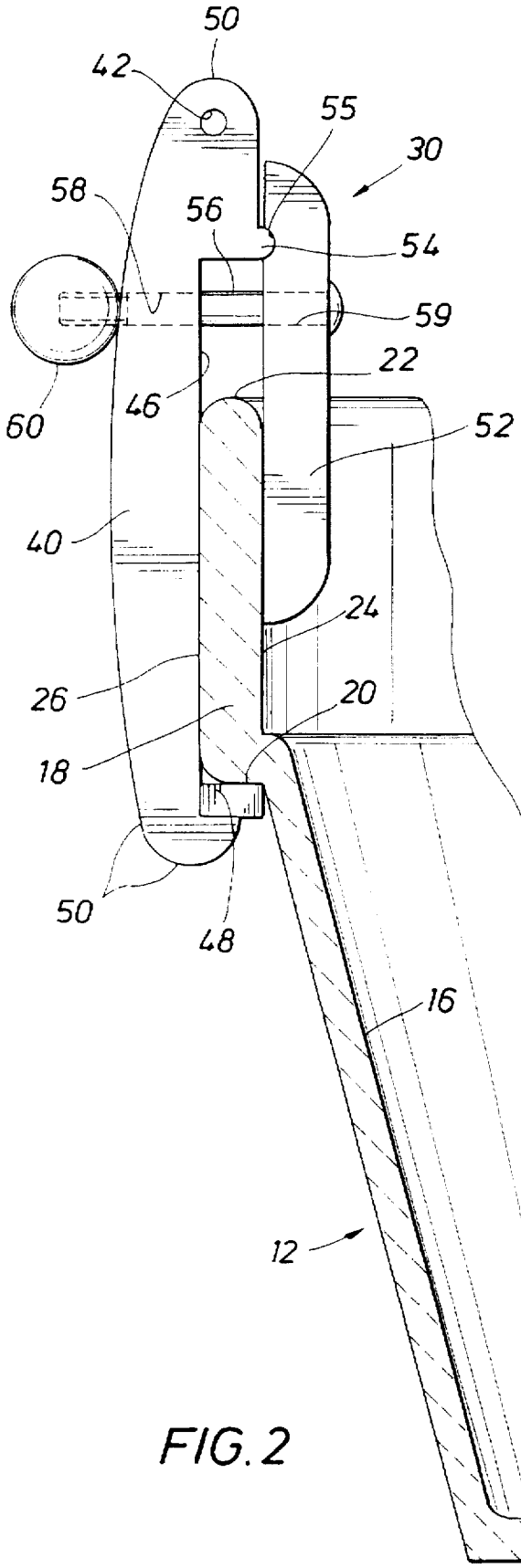
FIG. 2 is a sectional view through one hanger showing clamping on the rim of a clay pot and further showing how the hanger reaches under the rim to thereby support the clay pot.

In FIG. 2 of the drawings, each hanger clamp assembly 30 is constructed with left and right components which clamp around the lip or rim 18. On the left side, there is an external or left clamp arm 40 which is constructed with an upper pivot defined by a transverse hole 42 used in attaching each cooperating suspension member 32 as illustrated generally in FIG. 1. Specific means of attaching suspension members to clamp assemblies will be discussed in detail in a subsequent section of this disclosure. The suspension member 32 extends upwardly and has a specified length to enable connection to support the pot 12 at a desired spacing. The left arm 40 of the clamp assembly is constructed with an internal rectangular notch 46 which is as deep as the lip 18 is thick, and is as wide or wider than the lip 18. A pot rim support 48, which is an integral part of the clamp arm 40, reaches under the lip and latches to it. The rim support 48 is constructed so it fits under the shoulder of the lip 18 which defines a face 20, conforming to the face 20 and holding the nether face 20 for clamping.

The left arm 40 is provided with a radius of curvature 50 which can be approximately the same at both ends. This provides a relatively smooth surface which minimizes wear and snags. In addition, this enables the left arm to clamp while providing an attractive, highly desirable cosmetic appearance on the exterior.

Still referring to FIG. 2, an internal or right clamp arm is identified by the numeral 52. The right clamp arm 52 is not as tall as the left external clamp arm 40, and is constructed with an internal mating indention 55 to receive a fulcrum point 54 which is constructed on the left clamp arm 40. The fulcrum point 54 can be a short, cylindrical protrusion or ridge which is received in appropriate mating recession in the right arm. The shapes of the fulcrum point 54 and mating indention 55 are somewhat dependent upon the materials from which the clamp assembly 30 is constructed, as will be discussed subsequently. In addition to serving as a fulcrum for clamping action, the fulcrum point 54 and mating indention 55 serve a second purpose as a locking member for aligning the left arm 40 with the right arm 52. Without the fulcrum point and mating indention, the left and right arm tend to twist out of the desired face-to-face orientation. Closure of the clamp assembly and grasping of the clay pot is then achieved by means of a threaded pin or bolt 56 on the right arm 52. It is either threaded or glued so it is anchored to the right arm 52 and cannot rotate. An enlarged passage 58 is drilled through the left arm. The enlarged passage enables the threaded bolt 56 to extend fully through the left arm and protrude therebeyond. This enables a locking ball 60 to be threaded to the end of the threaded bolt 56. The ball 60 is rotated for threaded engagement. When threading is completed, the ball fastens snugly on the bolt 56, clamping the two clamping arms 40 and 52 together and thereby clamping the two arms of the clamp assembly 30 on the rim 18 of the pot 12. The ball 60 is preferably made of a decorative material such as wood, but can be made of plastic or metal. Alternate fasteners can be used in place of the ball such as a wingnut, acorn nut, or "slip and grip" fastener. In addition, the right arm 52 can be threaded to accept a threaded bolt 52 onto which a permanent ball 60 or other suitable fixture is affixed.

Figure 3A:
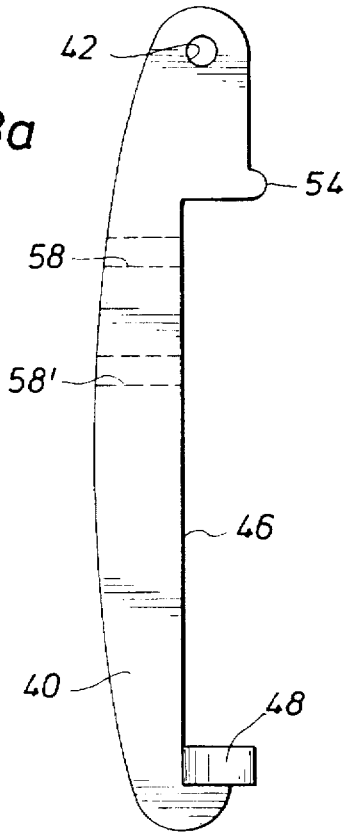
FIGS. 3*a*, 3*b* and 3*c* present three different views of an external clamp arm made from metal.
Figure 3B:
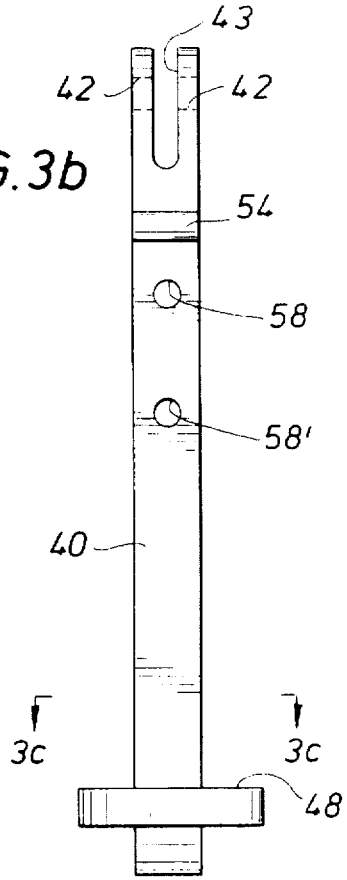
Figure 3C:
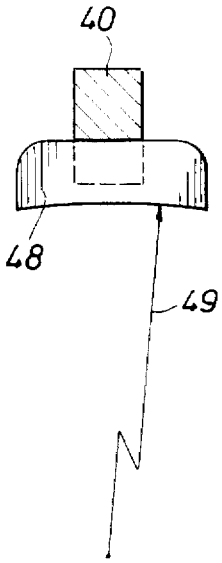

For a better understanding of the clamp assembly 30, attention is momentarily directed to FIGS. 3*a*, 3*b* and 3*c* of the drawings which illustrates three views of the exterior clamp arm fabricated of metal, such as aluminum to resist corrosion due to moisture. It has been found that the fulcrum point 54 can most effective be manufactured in the form of a horizontal, half cylindrical "ridge". This form of fulcrum point is most effectively illustrated in the inside face view FIG. 3*b* and is identified again with the numeral 54. Attention is next directed toward the pot rim support 48. The pot rim support is a horizontally extending member, as shown in FIGS. 3*b* and 3*c*, which is an integral part of the exterior or left clamp arm 40. The pot rim support 48 can be formed as a contiguous extension of the arm 40 or, alternately, manufactured as a separate piece and then affixed permanently to the clamp arm 40. Preferably, the horizontal extent of the rim support 48 is at least three times greater than the width of the exterior clamp arm 40. This provides radial support around the arc of the pot rim to allow the use of only two clamps, spaced at essentially 180 degrees on the pot rim, to support the pot with stability. The arc 49 of the rim support 48 is preferably that required to fit a pot with a eight inch radius. Two holes 58 and 58' are shown in FIGS. 3*a* and 3*b* for passage of the bolt 56 as compared to a single hole 58 shown penetrating the left clamp arm 40 in FIG. 2. It is preferable to form at least two holes within the arm 40 to allow adjustment for optimum clamping force for pot rims 18 which may vary in vertical dimension. A slot 43 and the hole 42 are used to pivotally attach a suspension member 32 to the clamp assembly 30 as will be discusses subsequently.

Figure 4A:
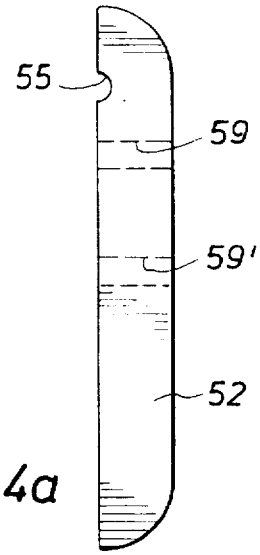
FIGS. 4*a* and 4*b* present two views of an internal clamp arm made from metal.
Figure 4B:
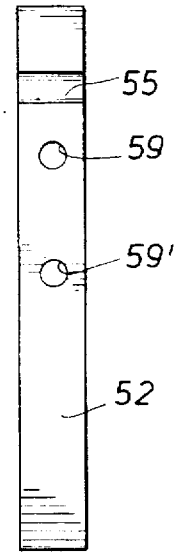

FIGS. 4*a* and 4*b* depict two views of the interior clamp arm 52 of a metallic clamp assembly. The right, half cylindrical, horizontal mating recession 55 in the inside face of the clamp arm 52 is clearly shown in both views. Two holes 59 and 59' are shown for the bolt 56 in FIGS. 4*a* and 4*b*, rather than one hole 59 as shown in FIG. 2. As mentioned previously, at least two holes are preferred to allow adjustment maximum clamping force for pots with lips 18 of varying vertical dimensions. In assembling the clamp on the pot rim, the rim support 48 is positioned against the under side 20 of the pot rim 18, the mating indention 55 of right clamp arm 52 is aligned with the fulcrum point 54 of the left clamp arm 40, the bolt 56 is inserted through the lowest completely exposed passage consisting of aligned holes 58 and 59 or holes 58' and 59', and the decorative ball 60 is threaded tight on the bolt 56. It should be pointed out that additional holes can be formed in the clamp arms 40 and 52 allowing additional flexibility in maximizing clamping force for varying rim sizes.

Figure 5A:
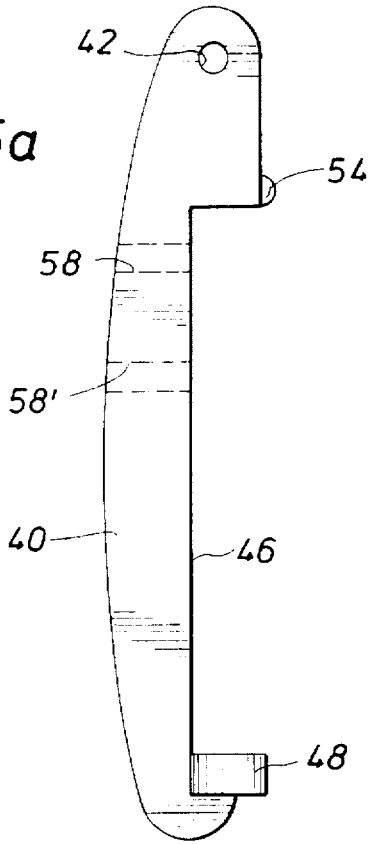
FIGS. 5*a*, 5*b*, and 5*c* present three different views of an external clamp arm made from plastic.
Figure 5B:
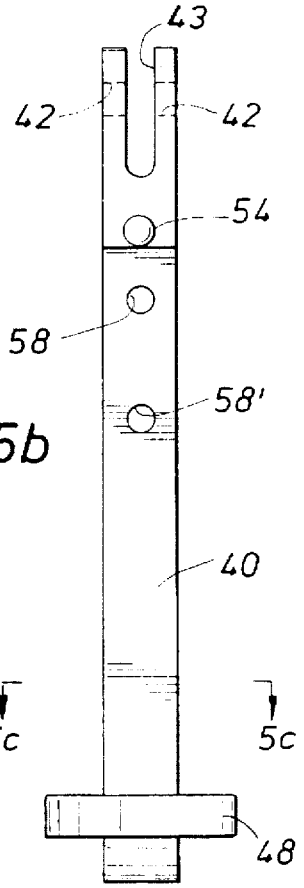
Figure 5C:
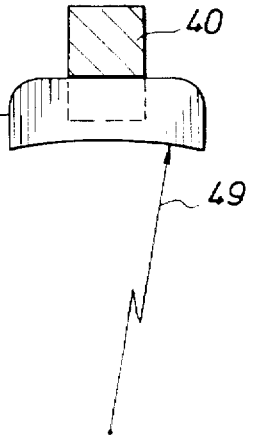

FIGS. 5*a*, 5*b* and 5*c* illustrate three views of a left clamp arm 40 which if formed from plastic. Plastic is a suitable material for the clamp assembly in that it is easily formed, relatively strong, and corrosion resistant. It has been found that in manufacturing clamp assemblies from plastic, it is preferred to form the fulcrum point 54 as half spherical "nose". This embodiment is shown clearly in the views of FIGS. 5*a* and 5*b*. Other than the form of the fulcrum point, the plastic exterior clamp arm show in FIGS. 5*a*, 5*b*, and 5*c* are the same as the metal exterior clamp shown in FIGS. 3*a*, 3*b*, and 3*c*.

Figure 6A:
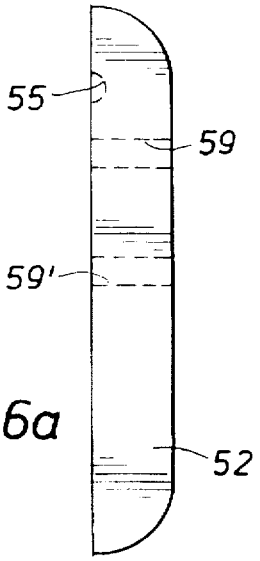
FIGS. 6*a* and 6*b* present two views of an internal clamp arm made from plastic.
Figure 6B:
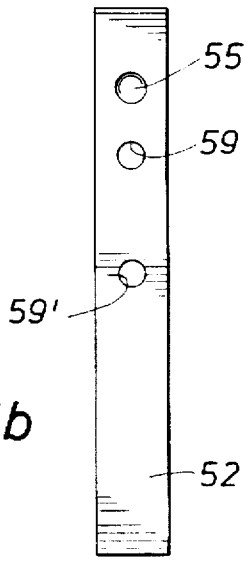

FIGS. 6*a* and 6*b* depict two views of the interior clamp arm 52 of a plastic clamp assembly. The right, half spherical mating recession 55 in the inside face of the clamp arm 52 is clearly shown in both views. Again, multiple holes for the bolt 56 are preferred, with two holes 59 and 59' being shown, to allow adjustment maximum clamping pressure for pots with lips 18 of varying vertical dimensions.

Various suspension members 32, and the means by which they are pivotally affixes to the clamp assembly 30, are shown in FIGS. 7*a*–7*e*. It should be understood that there are other equally effective embodiments of the suspension members and the means by which they are attached to the clamp assembly.

Figures 7A, 7B, 7C, 7D, 7E:
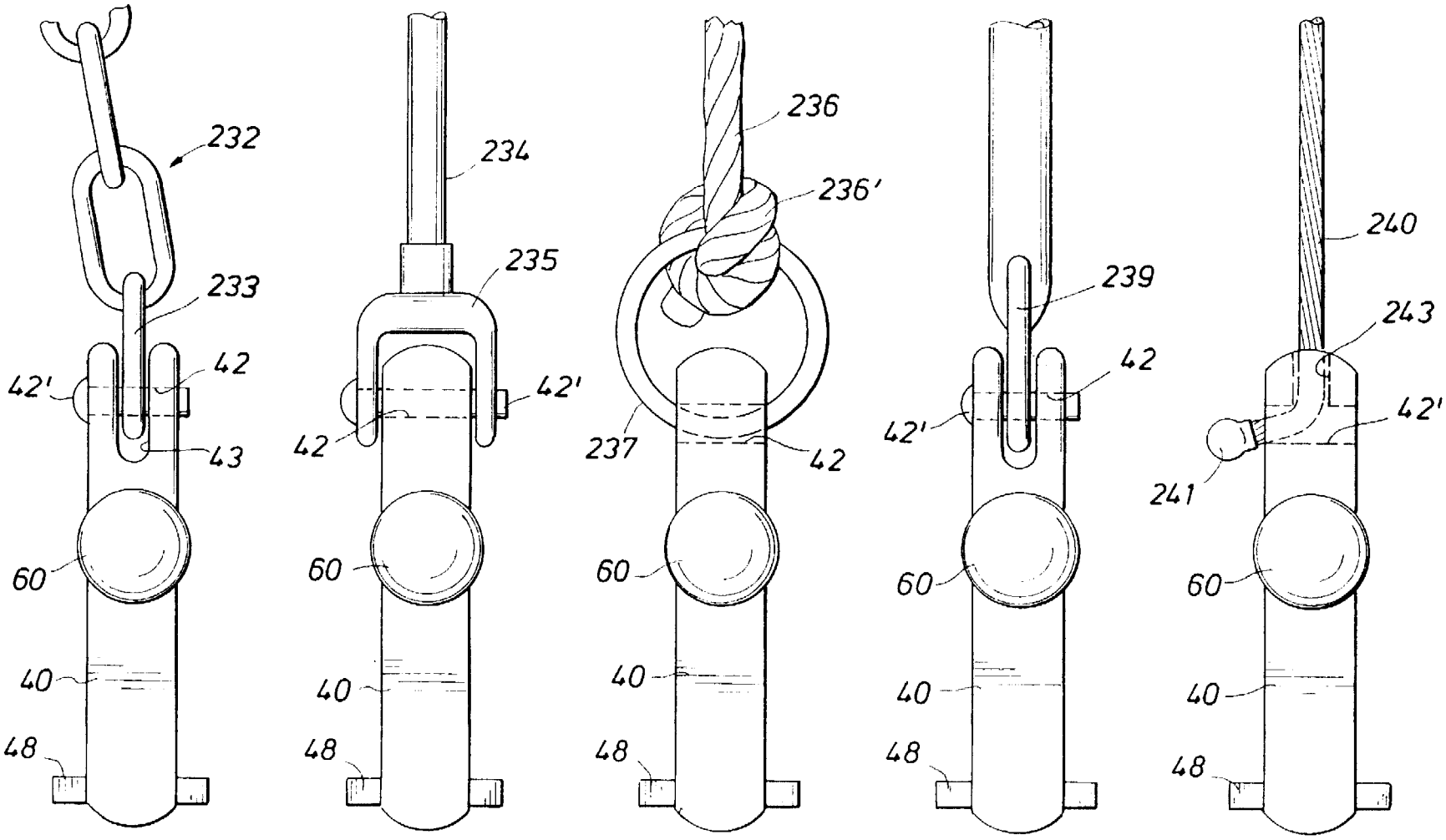
FIGS. 7*a*–7*e* illustrate means for attaching various types of suspension members to the external arm of a clamp element.

FIG. 7*a* shown a chain 232 used as a suspension member. The lower link 233 of the chain 232 is inserted into the slot 43 of exterior clamp arm 40, and a pin 42' is inserted through the hole 42 and link 233 thereby pivotally attaching the chain 232 to the exterior clamp arm 40 of the clamp assembly 30.

FIG. 7*b* shows a decorative rod 234 used as a suspension member. The lower end of the rod is attached to a clevis hinge 235. A pin 42' is inserted through the hole 42 in the exterior clamp arm 40 and through the clevis hinge thereby pivotally attaching the rod to the exterior clamp arm 40 of the clamp assembly 30.

FIG. 7*c* shows a rope 236 used as a suspension member. The lower end of the rope is attached by means of a knot 236' to a ring 237. The ring 237 passes through the hole 42 in the clamp arm 40 thereby pivotally attaching the rod to the exterior clamp arm 40 of the clamp assembly 30.

FIG. 7*d* again shows the decorative rod 234 used as a suspension member. The lower end of the rod is attached to a tongue 239. The pin 42' is inserted through the hole 42 in the exterior clamp arm 40 and through the tongue 239 thereby pivotally attaching the rod to the exterior clamp arm 40 of the clamp assembly 30.

FIG. 7*e* shows a preferably wire cable 240 used as a suspension member. The lower end of the cable passes through an essentially vertical hole 243 in the clamp arm 40 and out through the hole 42. A fitting 241 or alternately a knot is positioned on the lower end of the cable 140 so that this end will not pull through the holes 42 and 243 thereby pivotally attaching the cable to the exterior clamp arm 40 of the clamp assembly 30.

The suspension members shown in FIGS. 7*a*–7*e* can be made from a variety of materials. From a practical sense, the material must be strong enough to support a portion of the weight of the pot, and should be resistant to corrosion by conditions normally encountered by potter plants such as moisture. It is also desirable for the suspension members to be physically attractive. Suitable suspension member material includes metal which is preferably aluminum, plastic, fiber and cane.

The upper ends of the suspension members are attached to a central suspension point. The form of this central suspension point is governed somewhat by the type of suspension member used. FIG. 8 shows the upper hanger mechanism 34 for rod suspension members. More specifically, in FIG. 8 the rod 32 is provided with an enlargement 62 at the upper end to prevent it from passing through a passage 64 in the hanger plate 66. The plate 66 is provided with appropriate drilled passages 64 for the requisite number of rods 32 which extend therethrough. Easy assembly and disassembly is accomplished. In part, this is achieved by using a central drilled hole 68 in the center of the circular disk 66, and positioning a preferably decorative sphere 70 which is larger than the opening 68. This provides an easily connected rotatable pivot point. The pivot point is accomplished through the sphere 70 which has an upwardly extending eyelet 72 to serve as an overhead hook. In this arrangement of the apparatus shown in FIG. 8, it will be understood that typically two to four passages are drilled to hold two to four rods. More importantly, this allows the equipment to hang and thereby pivot to avoid problems of alignment or misalignment. Materials from which the hanger is formed should, in general, meet the previously discussed criteria for the selection of materials for other elements of the hanger.

Alternate upper hanging mechanisms are preferably employed depending upon the type of suspension member. FIG. 9 illustrates an alternate upper hanging mechanism for an embodiment in which chain 136 has been substituted for the rigid suspension member rods 32. The upper ends of the chain elements 136 are affixed to a ring 132 which is supported by a preferably decorative hook 130 affixed to an overhead support member 138 such as a ceiling beam or eave. This type of central suspension point is also preferred for rope and cable suspension members.

FIGS. 10*a* and 10*b* illustrate a non clamping version of the decorative hanger.

FIG. 10*a* depicts a sectional side view of the non clamping hanger element. The hanger body 104, which can be formed of plastic, metal or wood, contains a mating hole 103 near the lower end for a support pin 102 which is screwed or glued in the mating hole 103. The upper end of hanger body 104 is constructed with an upper pivot defined by the traverse hole and pivot pin 116. The pivot pin 116 connects with a clevis, a bifurcated connector 118 at the end of rod 114. The rod suspension member 114 extends upward and has a specified length to enable connection to support the clay pot 12 at a desired spacing. The support rod or dowel 102 fits under the lip 112 of the clay pot 12. Force moments are such that the inner face 128 of the hanger body 104 contacts the outer face 26 of the pot 12 at points identified by the numerals 110 and 112, and contacts the inner face 24 at point 111. The inner arm section 104' prevents the fixture from tilting such that the support rod 102 disengages from the pot rim. By using preferably three or more non clamping hangers spaced preferably evenly around the perimeter of the pot, the weight of the pot is thereby supported by at least three suspension member rods 114 which are connected to a suitable rod hanger such as the one illustrated in FIG. 8. It is noted that alternate types of suspension members such as chains, rope, or cable can be used. It is further noted that alternate connection means between the suspension member 114 and the body 104, such as those shown in FIGS. 7*a*–7*e*, can be used. It is still further noted that the suspension members can be affixed to alternate types of upper hanging mechanisms, such as those shown in FIGS. 8 and 9, depending upon the type of suspension member.

FIG. 10*b* illustrated the non clamping pot hanger as viewed from a position normal to the outer lip face 26 of the pot 12. The support dowel 102 is shown completely traversing the thickness of the hanger body 104. Alternately the mating hole for the support dowel can be drilled to only partially penetrate the hanger body 104. The elements of the non clamping type pot hanger can be made of materials which meet the same criteria as materials for the clamping type hangers.

To summarize, the clamp assemblies of the present pot hanger are installed at preferably two or three locations around the lip of a typical clay pot. Ordinarily, it is not necessary to use more than three clamp assemblies. The clamping type clamp assemblies are fitted with a rim support or "rest" which aids in gripping the pot and also permits the use of only two assemblies and still maintain a stable hanging pot. For the non clamping embodiment it is preferable to use at least three assemblies. It is possible to use the non clamping assemblies at only two connective points, but that leaves a somewhat tenuously balanced clay pot. Moreover, when that is done, it requires that the two opposing support elements be positioned diametrically opposite one another, and that type of precision is difficult to accomplish. In the preferred form the device is installed so that three or four support elements are used around the clay pot.

Grasping of the clay pot is successful through the use of the present apparatus. The grasp is accomplished at the nether face of the surrounding rim using the clamping embodiment. The grasp is accomplished at the outer face of the rim of the pot using the non clamping embodiment. In the non clamping embodiment, force moments are such that preferably three or more hanger elements spaced around the rim of the pot cooperate to support the weight of the pot as disclosed. In all embodiments, the grasping action is on the thickest part of the pot, and the possibility of crushing the pot, thereby damaging or destroying the pot, is nil. The preferred components are tightened, in the clamping embodiment, to finger tightness. Multiple bolt holes are used to allow selection of the position of the bolt to apply optimum grasping force. When that is done, the grasp is firm, but not overdone. When that is accomplished, the grasp is sufficient to hold for a long interval. Indeed, all embodiments of the device can hold a substantial weight.

While the foregoing is directed to the preferred embodiments, the scope of the present invention is set forth by the claims which follow.

What is claimed is:

1. A clay pot hanger comprising:

(a) two or more replicated pot rim clamps comprising two pivotally connected clamp arms, and a threaded clamping means for fixing the relative position of said clamping arms;

(b) upwardly extending suspension members from said clamps;

(c) an overhead and centralized support for said members; and (d) a rim engaging hook surface on each of said clamps to engage the rim of the pot at least two locations in a circle around said pot, (e) wherein a single pot rim clamp is pivotally connected to a single upwardly extending suspension member thereby forming a support member.

2. The hanger of claim 1 wherein each support member is pivotally connected to said overhead and centralized support.

3. The hanger of claim 1 wherein said upwardly extending suspension members comprise rods.

4. The hanger of claim 3 wherein said pot rim clamps, said rods, and said overhead and centralized support are metal, plastic or wood.

5. The hanger of claim 1 wherein said upwardly extending suspension members comprise chain.

6. The hanger of claim 1 wherein said upwardly extending suspension members comprise rope.

7. The hanger of claim 1 wherein said pot rim clamps are metal, plastic or wood.

8. The clay pot hanger of claim 1 wherein each of said replicated pot rim clamps further comprises a fulcrum point which also services as a locking mechanism.

9. A pot hanger for holding a clay pot constructed with an external upper rim having a nether lip therearound, the hanger comprising:

(a) at least two support structures, each comprising a hanger element comprising a hanger body with an outer arm and an inner arm which are connected at an upper end of said hanger body, a support dowel affixed to said outer arm in the vicinity of a lower end of said outer arm, wherein the axis of said dowel is essentially normal to the plane of said hanger body, and an upwardly extending suspension member comprising a lower end and an upper end wherein said lower end of said upwardly extending suspension member is affixed to said upper end of said hanger body; and (b) an upper hanger mechanism to which is affixed each said upper end of each said upwardly extending suspension member of each said support structure, wherein (c) each said upper end of each said upwardly extending suspension member is pivotally affixed to said upper hanger mechanism.

10. The pot hanger of claim 9 wherein said upwardly extending suspension members comprise a rod.

11. The pot hanger of claim 9 further comprising a clamp and wherein said clamp is metal, plastic or wood.

12. The pot hanger of claim 9 wherein said support structures and said upper hanger mechanism are metal, plastic or wood.

13. The pot hanger of claim 9 further comprising a fulcrum point which also serves as a locking member.

* * * * *